US009963877B2

(12) United States Patent
Hall et al.

(10) Patent No.: US 9,963,877 B2
(45) Date of Patent: May 8, 2018

(54) MODULAR PRISMATIC BOX-LIKE STRUCTURE-BASED BUILDING METHOD AND INFRASTRUCTURE

(71) Applicants: David R. Hall, Provo, UT (US); Benjamin Jensen, Orem, UT (US); Max Tarver, Provo, UT (US); Eimi Priddis, Mapleton, UT (US)

(72) Inventors: David R. Hall, Provo, UT (US); Benjamin Jensen, Orem, UT (US); Max Tarver, Provo, UT (US); Eimi Priddis, Mapleton, UT (US)

( * ) Notice: Subject to any disclaimer, the term of this patent is extended or adjusted under 35 U.S.C. 154(b) by 0 days. days.

(21) Appl. No.: 15/157,742

(22) Filed: May 18, 2016

(65) Prior Publication Data

US 2017/0335562 A1 Nov. 23, 2017

(51) Int. Cl.

| | |
|---|---|
| ***E04B 1/348*** | (2006.01) |
| ***E04C 2/54*** | (2006.01) |
| ***E04H 1/00*** | (2006.01) |
| ***E04B 1/14*** | (2006.01) |
| ***E04B 1/61*** | (2006.01) |

(52) U.S. Cl.

CPC ..... *E04C 2/54* (2013.01); *E04B 1/14* (2013.01); *E04B 1/34853* (2013.01); *E04B 1/34861* (2013.01); *E04B 1/6104* (2013.01); *E04H 1/005* (2013.01)

(58) Field of Classification Search

CPC .. E04B 1/34861; E04B 1/34853; E04H 1/005
USPC ..... 52/DIG. 10, 81.1, 284, 421
See application file for complete search history.

(56) References Cited

U.S. PATENT DOCUMENTS

| | | | | | |
|---|---|---|---|---|---|
| 1,543,999 | A * | 6/1925 | Goldsmith | A45C 5/04 | 190/37 |
| 2,347,192 | A * | 4/1944 | Grice | A45C 5/04 | 190/19 |
| 2,626,025 | A * | 1/1953 | Sherman | A45C 5/04 | 190/28 |
| 3,430,398 | A * | 3/1969 | Green | E04L 31/34861 | 52/263 |
| 3,510,997 | A * | 5/1970 | Ratych | E04L 31/34823 | 52/262 |
| 3,520,098 | A * | 7/1970 | Johnston | A47B 87/00 | 108/101 |
| 3,577,672 | A * | 5/1971 | Nutting | A63H 3/52 | 446/85 |

(Continued)

*Primary Examiner* — Andriana Figueroa

(57) ABSTRACT

A green or sustainable building infrastructure comprising conjoining modular building segments. The purpose of the invention is to increase the precision, quality, and timing of building projects by allowing modular building segments to be constructed in an off-site controlled environment, transported, and quickly assembled on site. The conjoining modular building segments are prismatic box-like structures conjoined in a variety of configurations, each having at least three walls. The prismatic box-like structures are arranged and attached horizontally to create ceilings and floors, and they are arranged and attached vertically to create walls for the infrastructure. Some of the walls may be removed and the space inside each prismatic box-like structure is available for storage. The prismatic box-like structures may have certain dimensions, comprise specific materials, or be constructed or conjoined in specific ways.

24 Claims, 12 Drawing Sheets

(56) References Cited

U.S. PATENT DOCUMENTS 3,707,813 A * 1/1973 Cymbrowitz ..... E04B 1/34807 52/653.1
3,866,672 A * 2/1975 Rich, Jr. ..... E04L 31/34807 165/50
3,894,373 A * 7/1975 Willingham ..... E04L 31/34823 52/236.3
3,897,662 A * 8/1975 Fencl ..... E04B 1/34861 52/223.8
3,965,626 A * 6/1976 Johnson ..... E04B 1/34815 52/652.1
3,990,193 A * 11/1976 Ray ..... E04L 31/162 52/745.03
4,118,905 A * 10/1978 Shelley ..... E04L 31/34823 52/236.4
4,359,842 A * 11/1982 Hooker ..... A63H 33/16 52/18
4,364,206 A * 12/1982 Wybauw ..... E04L 31/3483 52/185
4,599,829 A * 7/1986 DiMartino, Sr. ... E04L 31/3483 410/79
4,744,445 A * 5/1988 Anderson ..... A45C 5/02 190/107
5,540,013 A * 7/1996 Diamond ..... E04B 1/32 52/646
5,560,151 A * 10/1996 Roberts ..... E04B 1/3205 52/245
5,755,063 A * 5/1998 Ohnishi ..... E04L 31/3483 52/127.2
5,873,206 A * 2/1999 Roberts ..... E04B 1/3205 52/245
6,070,373 A * 6/2000 Diamond ..... E04B 1/19 52/81.1
6,076,318 A * 6/2000 Grimm ..... E04B 1/3205 426/122
6,173,538 B1 * 1/2001 Fleishman ..... E04B 1/3211 52/284
6,282,849 B1 * 9/2001 Tuczek ..... E04B 1/32 52/648.1
6,332,298 B1 * 12/2001 Bigelow ..... E04L 31/34321 52/125.2
6,711,860 B2 * 3/2004 Fleishman ..... E04B 1/61 403/375
7,458,186 B2 * 12/2008 Carter ..... A63H 33/008 446/108
7,827,738 B2 * 11/2010 Abrams ..... E04B 1/003 52/79.1
2007/0271857 A1 * 11/2007 Heather ..... B65D 88/005 52/79.9
2008/0066393 A1 * 3/2008 Sorensen ..... A63H 33/101 52/81.1
2011/0056147 A1 * 3/2011 Beaudet ..... E04L 31/3483 52/79.9
2015/0121772 A1 * 5/2015 Berken ..... E04L 31/34331 52/28

* cited by examiner

FIG. 4D
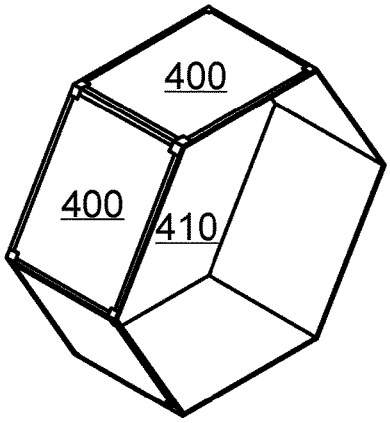
FIG. 4A
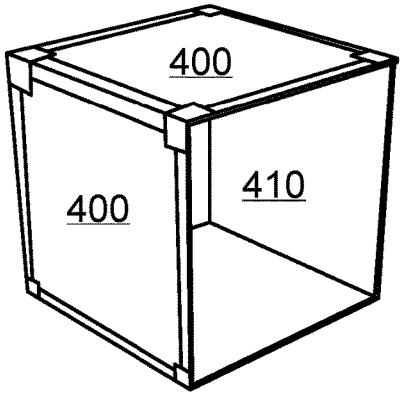
FIG. 4C
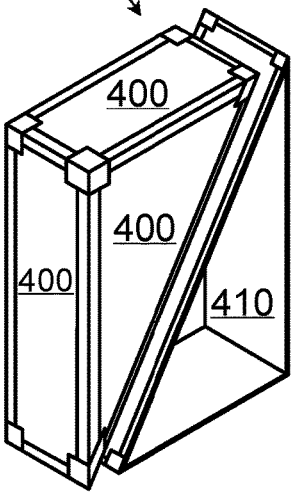
FIG. 4B
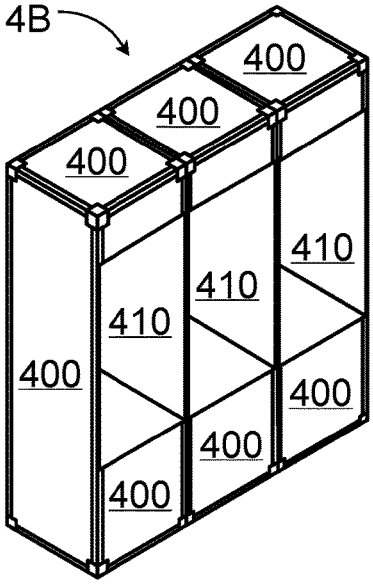
FIG. 4

MODULAR PRISMATIC BOX-LIKE STRUCTURE-BASED BUILDING METHOD AND INFRASTRUCTURE

CROSS-REFERENCES

Technical Field

This invention relates generally to the field of construction of buildings and other structures, and more specifically to the construction of green or sustainable buildings using modular segments.

BACKGROUND

Constructing a green or sustainable building or another structure is a complex process that requires significant amounts of time, resources, and collaboration from many fields of endeavor. Through the years, different techniques have been developed to try to maximize the efficiency and economy of the process. The most common current building techniques involve the use of standardized building components that are shipped to the construction site in small pieces and assembled on site.

However, when such methods are used, a green or sustainable building or other structure can take months or even years to build. The building project is consequently subjected to unpredictable weather conditions, and great exertions must be made to store and protect tools and resources. Resources may be wasted. Furthermore, even though efficient modern assembly techniques have driven down prices for many industrial and consumer products—such as cars, machinery, clothing, and electronics—such techniques are not fully taken advantage of in constructing green or sustainable buildings. Overall, the current methods lose the potential benefits of quality, precision, efficiency, and optimal timing that are possible through the manufacture of modular building segments in a controlled environment as described herein.

In view of the foregoing, what is needed is a green or sustainable and efficient building design that will allow the main infrastructure of a building or another structure to be manufactured in a controlled off-site environment and then be transported to a building site and quickly assembled on site to form the finished building or other structure. Such a technique would need to preserve or improve the structural integrity of the building, use efficient building techniques, provide for efficient temperature control and access to utilities within the building, and optimize the use of resources by integrating the infrastructure into the overall functionality of the building. Furthermore, unlike current modular green or sustainable building systems, such a building design should allow for an infinite variety of configurations to appeal to myriad preferences and needs.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow the infrastructure of green or sustainable buildings and other structures to be built using a new style of conjoining modular building segments that may be constructed in an off-site, controlled environment.

Consistent with the foregoing, a green or sustainable building constructed with conjoining modular building segments is disclosed. In one embodiment, such a building comprises a plurality of prismatic box-like structures having at least three walls. A space inside the walls measures at least one square foot. In one embodiment, a first selection of the prismatic box-like structures are placed side by side horizontally and mechanically attached to form at least a length and width of one ceiling. A second selection of the prismatic box-like structures are placed side by side horizontally and mechanically attached to form a length and width of at least one floor. A third selection of the plurality of prismatic box-like structures are placed side by side vertically and mechanically attached to form a plurality of walls of the building infrastructure. The prismatic box-like structures comprise an apparatus suitable for disposition of a stored item. The prismatic box-like structures provide for the efficient use of space and, in certain embodiments, have certain dimensions, comprise specific materials, or are constructed or conjoined in specific ways. A corresponding method is also disclosed and claimed herein.

BRIEF DESCRIPTION OF THE DRAWINGS

A more particular description of the invention briefly described above is made below by reference to specific embodiments depicted in drawings included with this application, in which:

FIG. 4 depicts perspective views of different embodiments of the conjoining modular building segments, which are prismatic box-like structures;

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
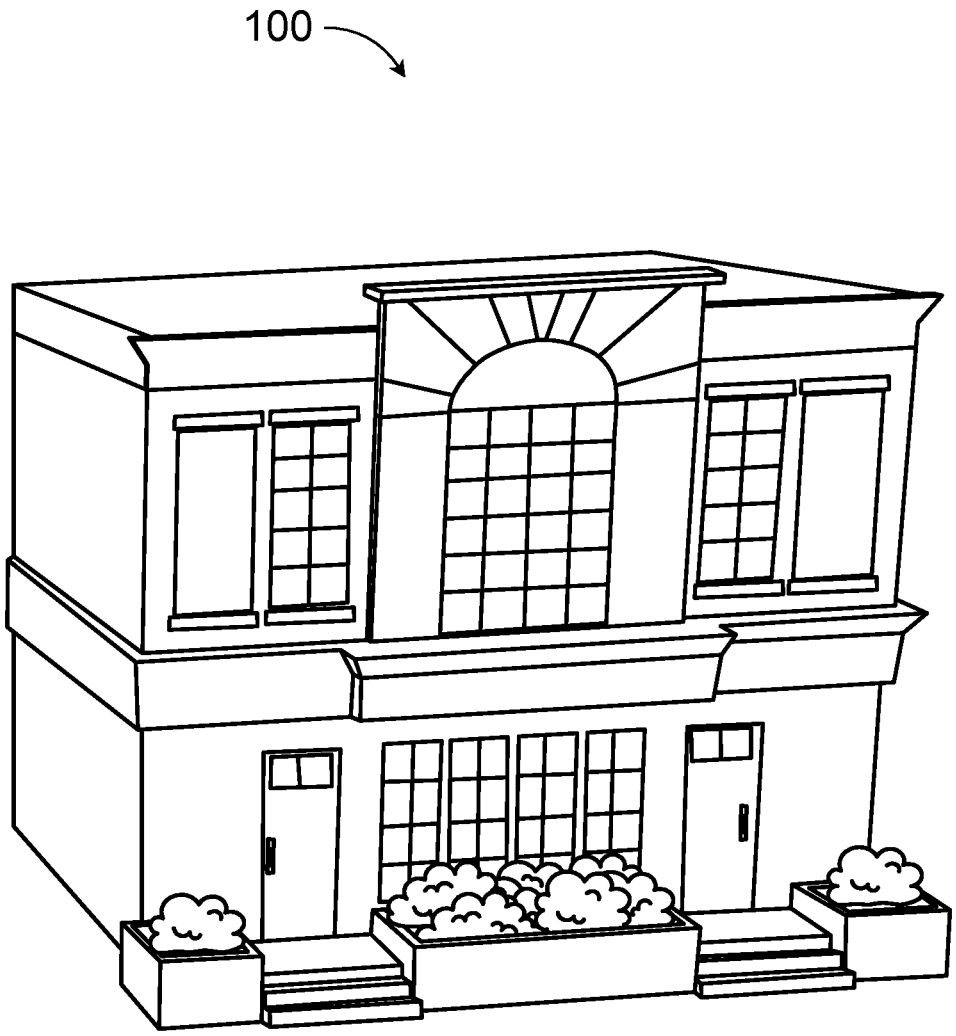
FIG. 1 depicts a perspective view of a finished building built in accordance with the invention.

FIG. 1 depicts a perspective view of one embodiment of a building 100 built in accordance with the invention. As shown, the outer finish of building 100 may be a façade with any variety of architectural embellishments. Inside the outermost walls, though unseen, is the building infrastructure comprising a plurality of conjoining modular building segments.

Figure 2:
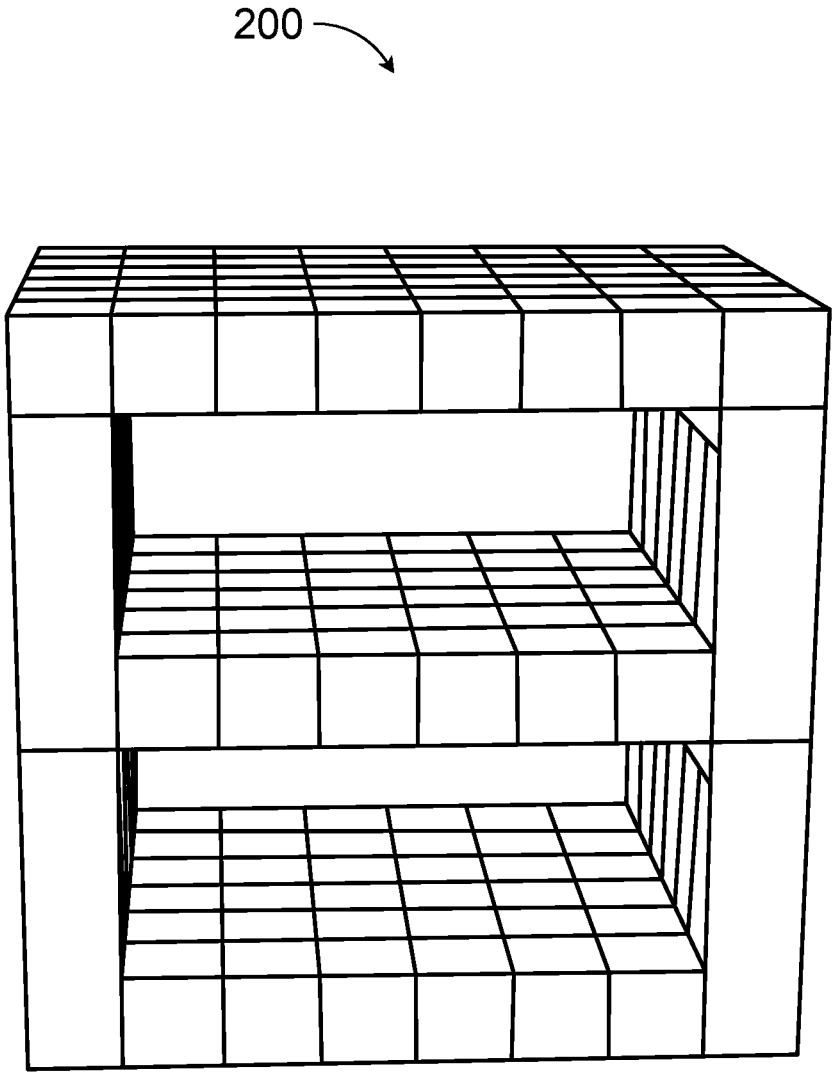
FIG. 2 depicts a perspective view of a building infrastructure comprising a plurality of conjoining modular building segments.

FIG. 2 depicts building infrastructure 200, which comprises a plurality of conjoining modular building segments, the plurality of conjoining modular building segments being prismatic box-like structures.

Figure 3:
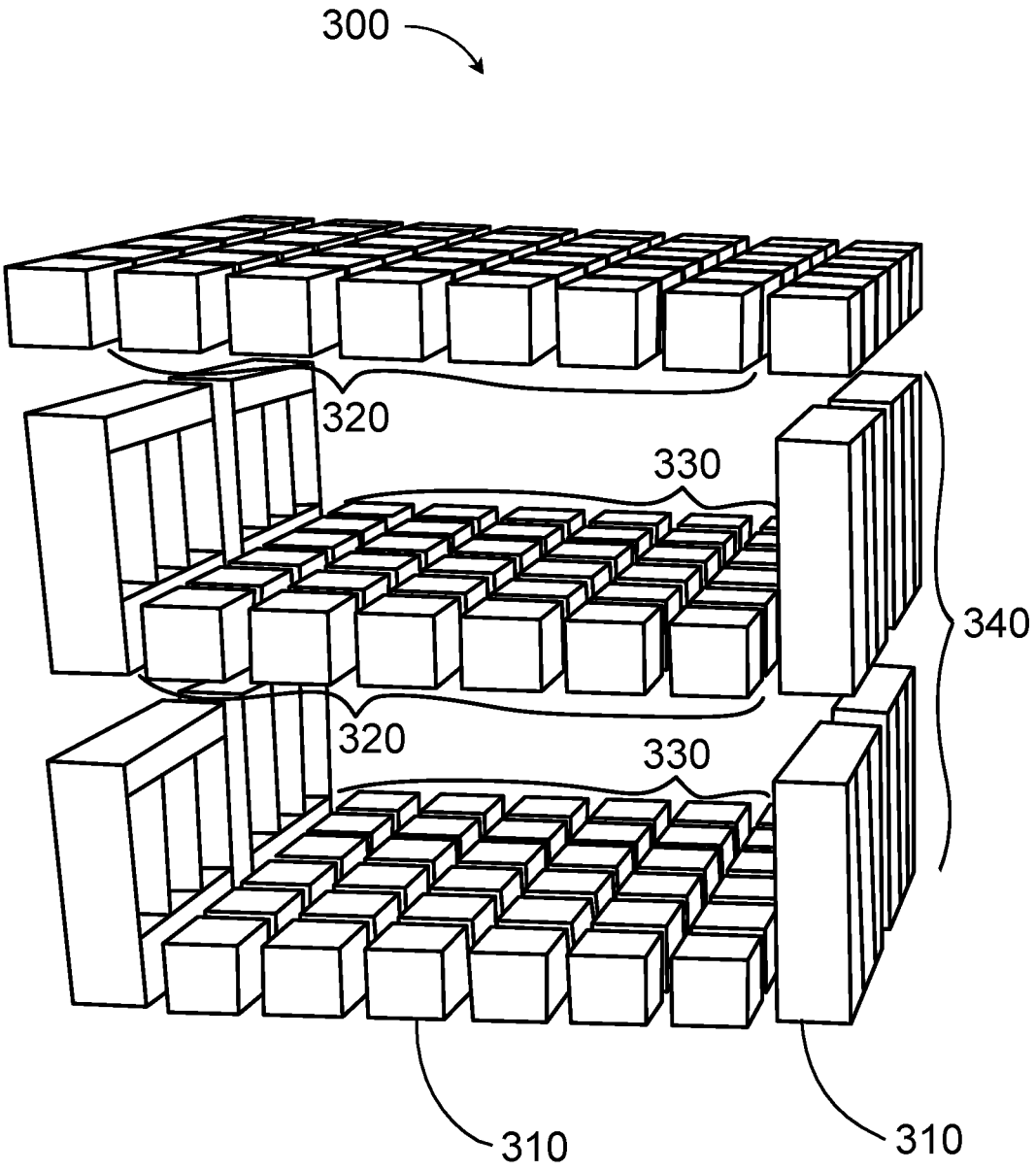
FIG. 3 depicts a perspective view of the plurality of conjoining modular building segments arranged to create the building infrastructure.

FIG. 3 depicts building infrastructure 300, but each individual prismatic box-like structure 310 is visible. Building infrastructure 300 further depicts a first selection 320 of the plurality of prismatic box-like structures, placed side by side horizontally and mechanically attached to form a length and width of at least one ceiling. A second selection 330 of the plurality of conjoining modular building segments are placed side by side horizontally and mechanically attached to form a length and width of at least one floor. A third selection 340 of the plurality of conjoining modular building segments are placed side by side vertically and mechanically attached to each other and to at least one ceiling and at least one floor to form a plurality of walls for the building infrastructure.

FIG. 4 depicts perspective views of different embodiments of the prismatic box-like structures. The prismatic box-like structures may comprise different shapes, including shapes like cubic 4A, rectangular 4B, triangular 4C, and hexagonal 4D. Each prismatic box-like structure comprises at least three walls 400. Each prismatic box-like structure comprises an apparatus suitable for disposition of a stored item. A space 410 inside the walls measures at least one cubic foot. It is crucial that the space within the walls be at least one cubic foot in order that items can be stored within the prismatic box-like structures, thus maximizing space and overall efficiency and sustainability of the building infrastructure.

Figure 5:
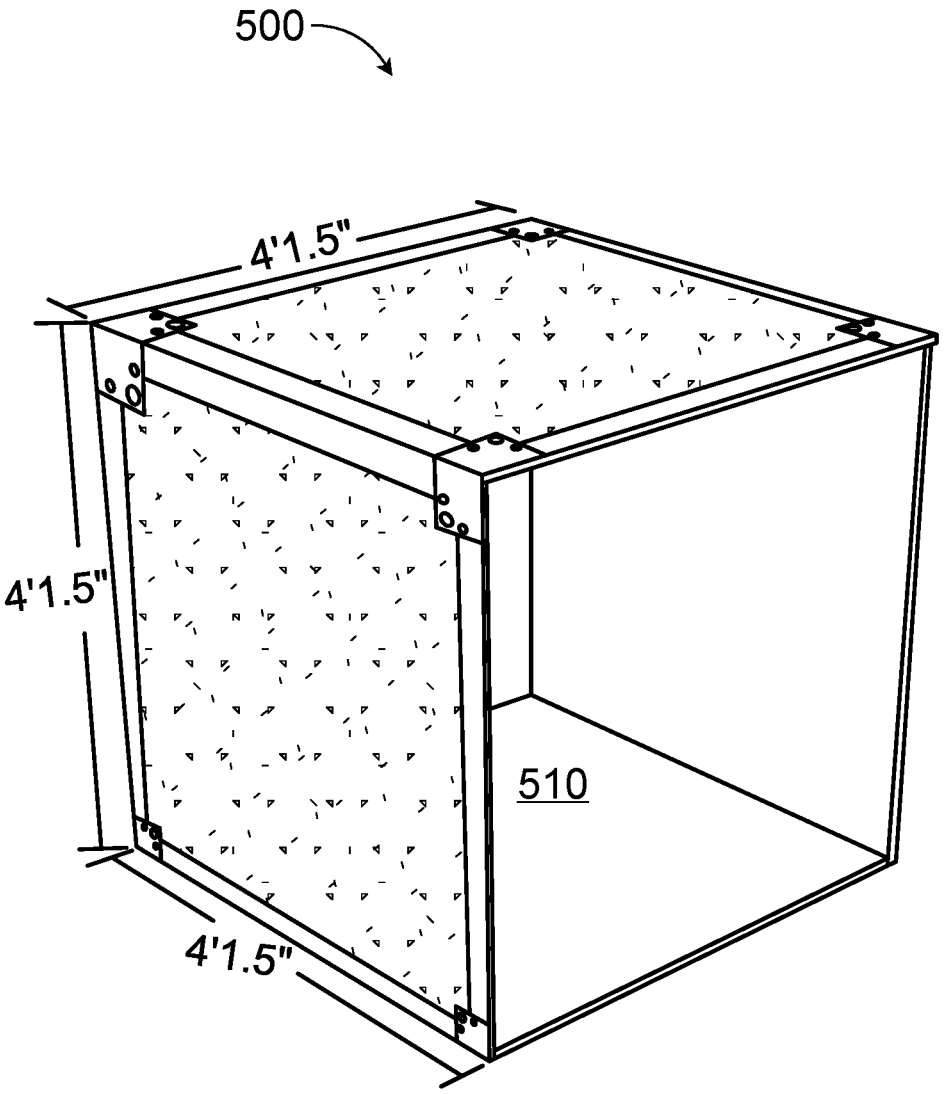
FIG. 5 depicts a perspective view of the first and second selections of the plurality of prismatic box-like structures that are placed side by side horizontally and mechanically attached to form at least a length and width of one ceiling and at least a length and width of one floor in the building infrastructure.

FIG. 5 depicts a single prismatic box-like structure 500 from the first and second selections of prismatic box-like structures that are placed side by side horizontally and mechanically attached to form at least a length and width of at least one ceiling and a length and width of at least one floor. Height, length, and width measurements of the first and the second selection of prismatic box-like structures are about four feet and one and one-half inch (1.295400 meters). A top wall or a bottom wall may be removed for storage purposes. A volume of the space 510 within the walls of the first selection of prismatic box-like structures measures about 64 cubic feet (1.81228 cubic meters). The volume of the space 510 within the walls is crucial in order that items can be stored within the prismatic box-like structures, thus maximizing space and overall efficiency and sustainability of the building infrastructure. The items that may be stored in the space within the walls include furniture, appliances, utilities, food, clothing, personal items, and so forth.

Figure 6:
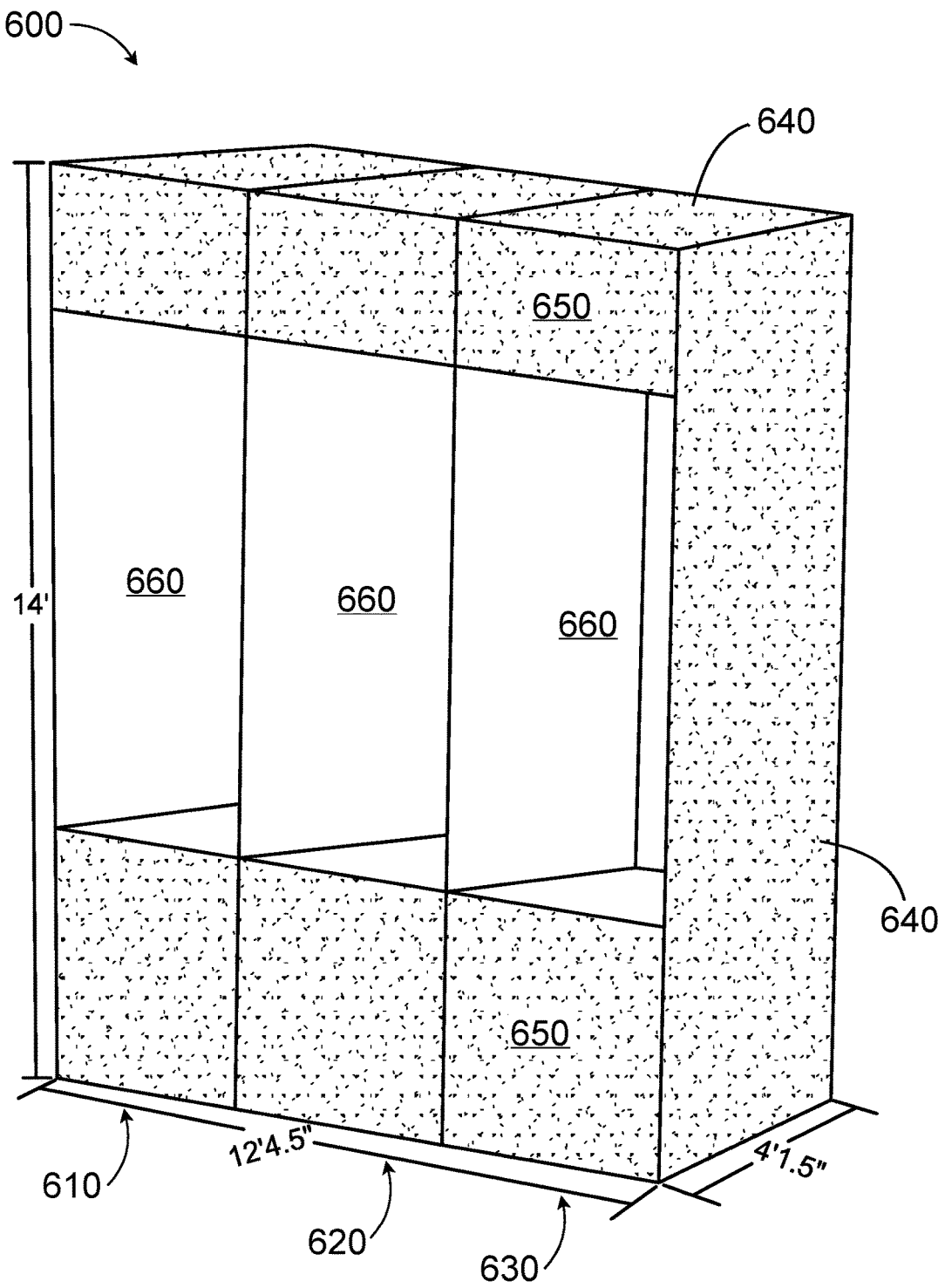
FIG. 6 depicts a perspective view of the third selection of the plurality of prismatic box-like structures that are placed side by side vertically and mechanically attached to form a plurality of walls for the building infrastructure.

A single prismatic box-like structure 600 depicted in FIG. 6 is one of a plurality of prismatic box-like structures that comprise the third selection of prismatic box-like structures that are placed side by side vertically and mechanically attached to each other and to at least one ceiling and at least one floor to form a plurality of walls of the building infrastructure. In one embodiment, at least one wall of the third selection of prismatic box-like structures comprises an optically transparent or semi-optically transparent material, such as glass. The third selection of prismatic box-like structures 600 measure about fourteen feet (4.2672 meters) in height. Length and width measurements are about four feet and one and one-half inch (1.295400 meters). In one embodiment, prismatic box-like structure 600 is constructed from three prismatic box-like structures 610, 620, and 630 joined together, each having only five full walls 640, with the front wall 650 open for a purpose of storing items such as kitchen appliances, elevators, or bathroom hardware. A volume of the space 660 within the walls of the third selection of prismatic structures measures about 224 cubic feet (6.34297 cubic meters). The volume of the space 660 within the walls is crucial in order that items can be stored within the prismatic box-like structures, thus maximizing space and overall efficiency and sustainability of the building infrastructure. A variety of items may be stored in the prismatic box-like structures, including furniture, appliances, utilities, elevators, carousels, food, clothing, toilets, tubs, showers, beds, movable walls, and so forth.

Figure 7:
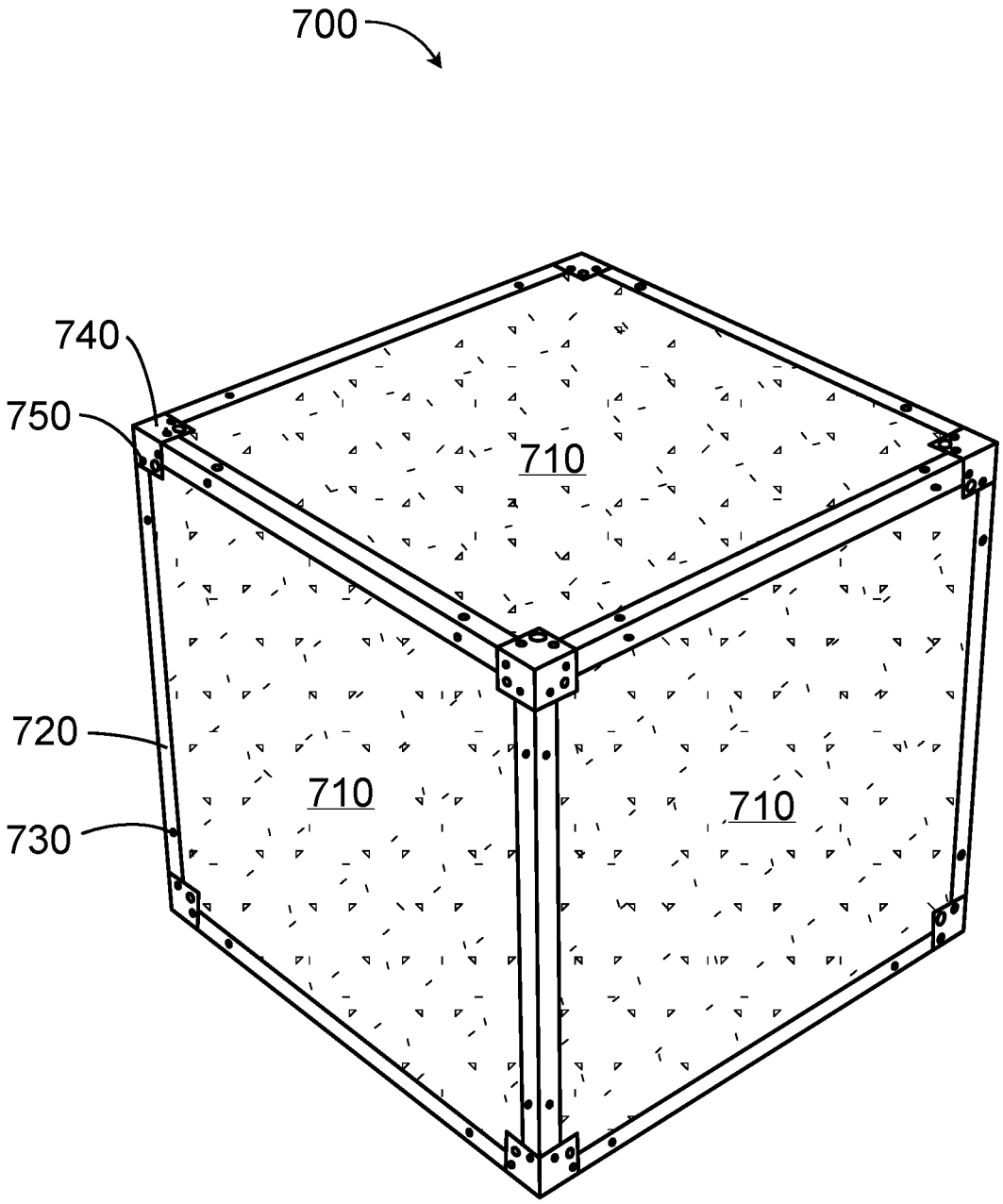
FIG. 7 depicts an exploded view of one prismatic box-like structure.

FIG. 7 depicts one embodiment of a single prismatic box-like structure 700. In one embodiment, walls 710 of prismatic box-like structure 700 comprise OSB, reinforced OSB, or lightweight OSB. In other embodiments, the walls 710 comprise other engineered materials, such as engineered wood, composite board, particle board, press board, plywood, wood laminate, chip board, gypsum board, cement board, carbon fiber materials, or combinations thereof. In still other embodiments, the walls 710 of prismatic box-like structure 700 comprise an optically transparent or semi-optically transparent material, such as glass, or at least one wall comprises a translucent material. Walls 710 of prismatic box-like structure 700 are joined together by means of metal plates 720 and brackets 740 mechanically secured along the perimeter of the walls. The metal plates 720 are wrapped around two adjoining wall edges and secured with connectors 730. The connectors 730 may include screws, bolts, rivet nuts, T-nuts, or other durable connectors, some of which are removable, and some of which are not. The walls 710 of the prismatic box-like structures are joined together at top and bottom edges with metal brackets 740 that are secured by connectors 750.

Figure 8:
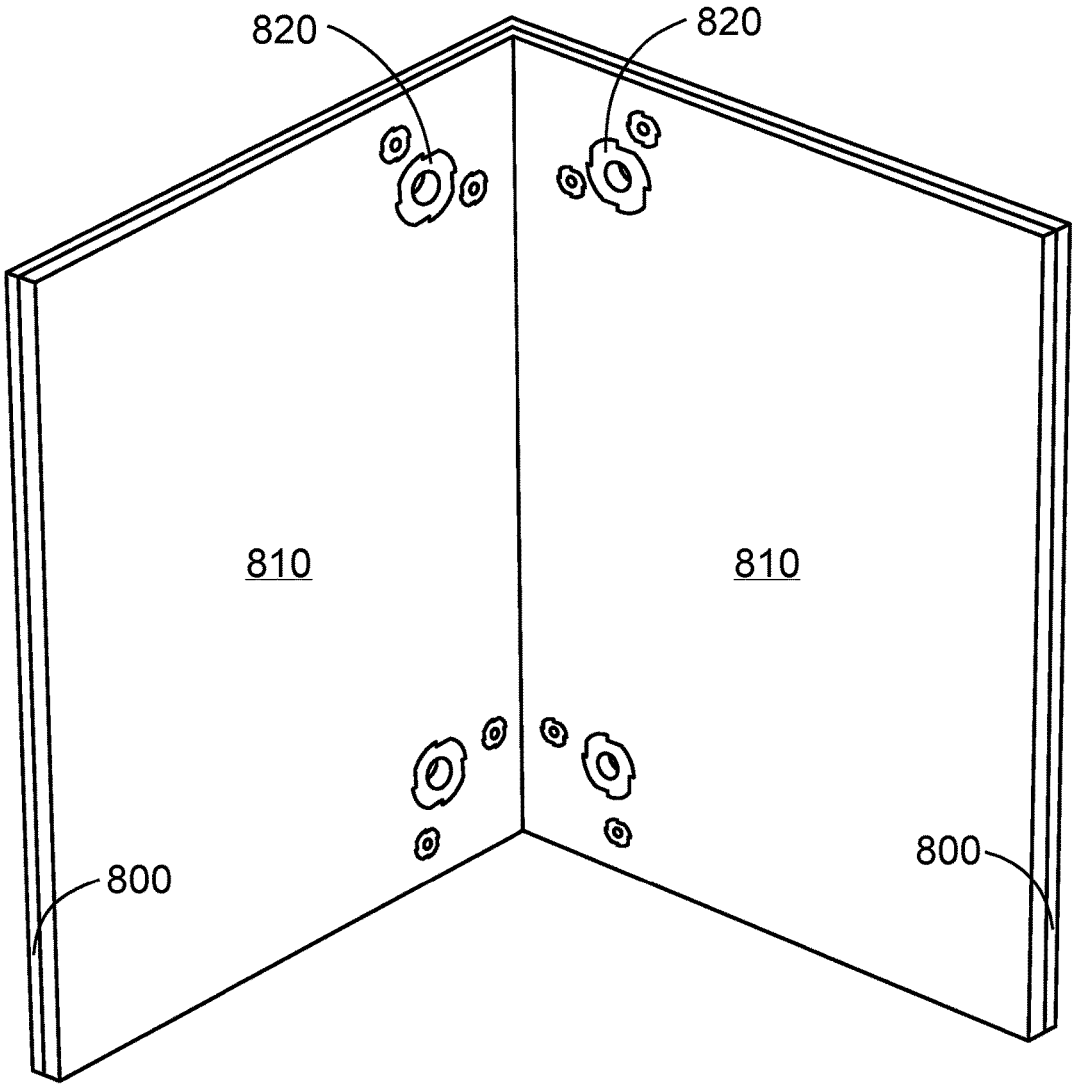
FIG. 8 depicts an exploded view of mass loaded vinyl (MLV) attached to at least one side of the walls of the prismatic box-like structures.

Referring to FIG. 8, a mass loaded vinyl (MLV) material 810 is limply attached to at least one side of the walls 800 of the prismatic box-like structures. The MLV material comprises a thickness of about one-thirty-second (0.079375 cm) to about one-fourth inch (0.635 cm). The MLV is limply attached with connectors 820 and an adhesive. One purpose of the MLV is for blocking sound.

Figure 9:
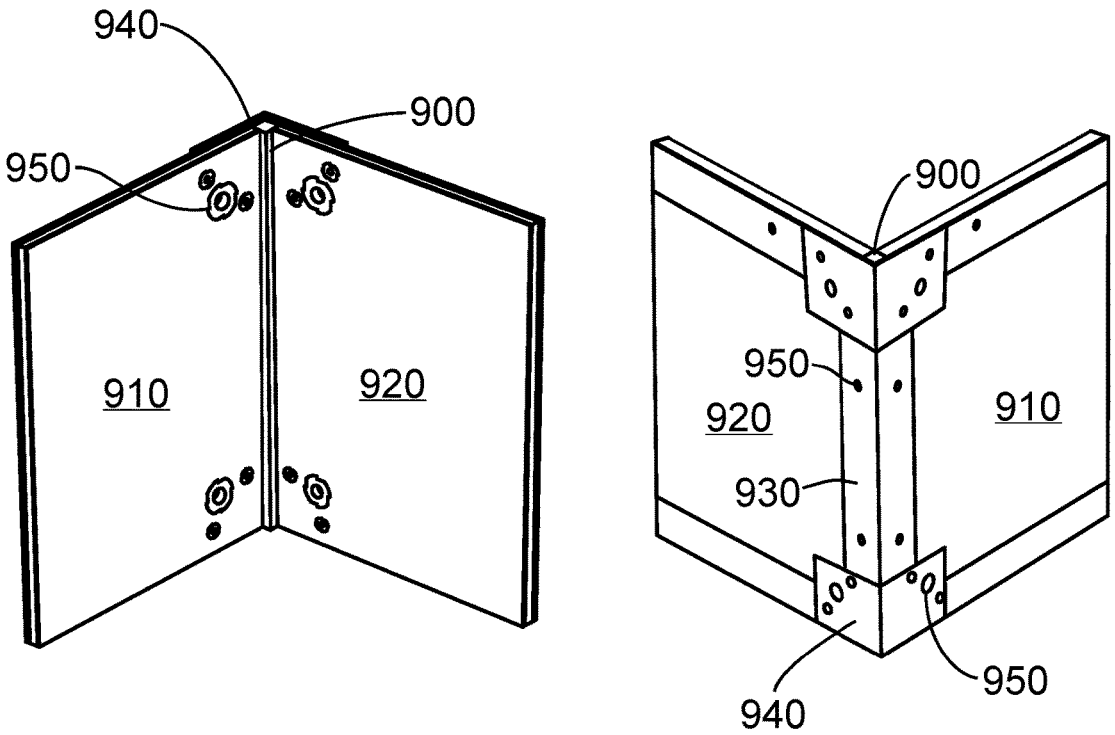
FIG. 9 depicts a front and a back exploded view of the square-shaped steel bars that are secured in each perpendicular corner of each prismatic box-like structure.

Referring to FIG. 9, the walls of the prismatic box-like structures are joined in each perpendicular corner by means of square-shaped steel bars 900 mechanically attached to the walls. The square-shaped steel bars 900 are secured in each perpendicular corner of each prismatic box-like structure, spanning a length of each corner, by bringing edges of two adjoining walls 910 and 920 together at approximately a ninety-degree angle, touching two adjacent sides of the square-shaped steel bars 900. This configuration is secured by wrapping a metal plate 930 around the square-shaped steel bars 900 and edges of two adjoining walls 910 and 920. The metal plate 930 is secured with connectors 950. At top and bottom edges of the walls, this configuration is secured using metal brackets 940 and connectors 950.

Figure 10:
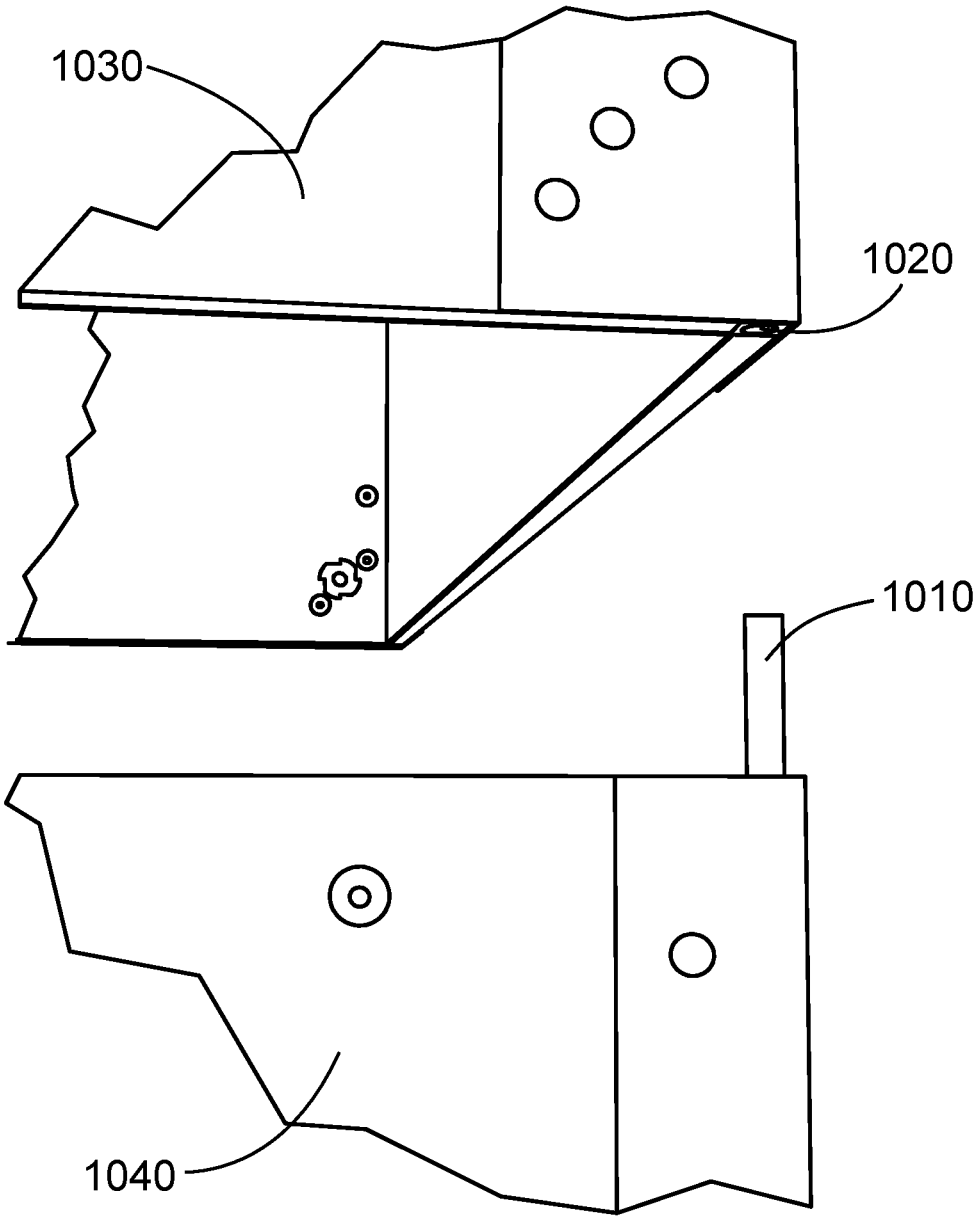
FIG. 10 depicts an exploded view of two configurations of the square-shaped steel bars and a method for attaching two prismatic box-like structures vertically.

As depicted in FIG. 10, the square-shaped steel bar may comprise one of two configurations, a first configuration 1010 having a protrusion that extends beyond the prismatic box-like structure in length, and a second configuration 1020 having a hollow indentation. The two configurations comprise male and female ends of the square-shaped steel bar. The prismatic box-like structures that are vertical and used to form the plurality of walls of the building infrastructure, such as prismatic box-like structures 1030 and 1040, are mechanically attached by being stacked and pinned by inserting the first configuration 1010 into the second configuration 1020. The second configuration 1020 also allows for telescoping, so that, in one embodiment, top walls of the prismatic box-like structures can be raised or lowered, allowing access to the space within the walls of the prismatic box-like structures. The space within the walls can be used for storing a variety of items.

Figure 11:
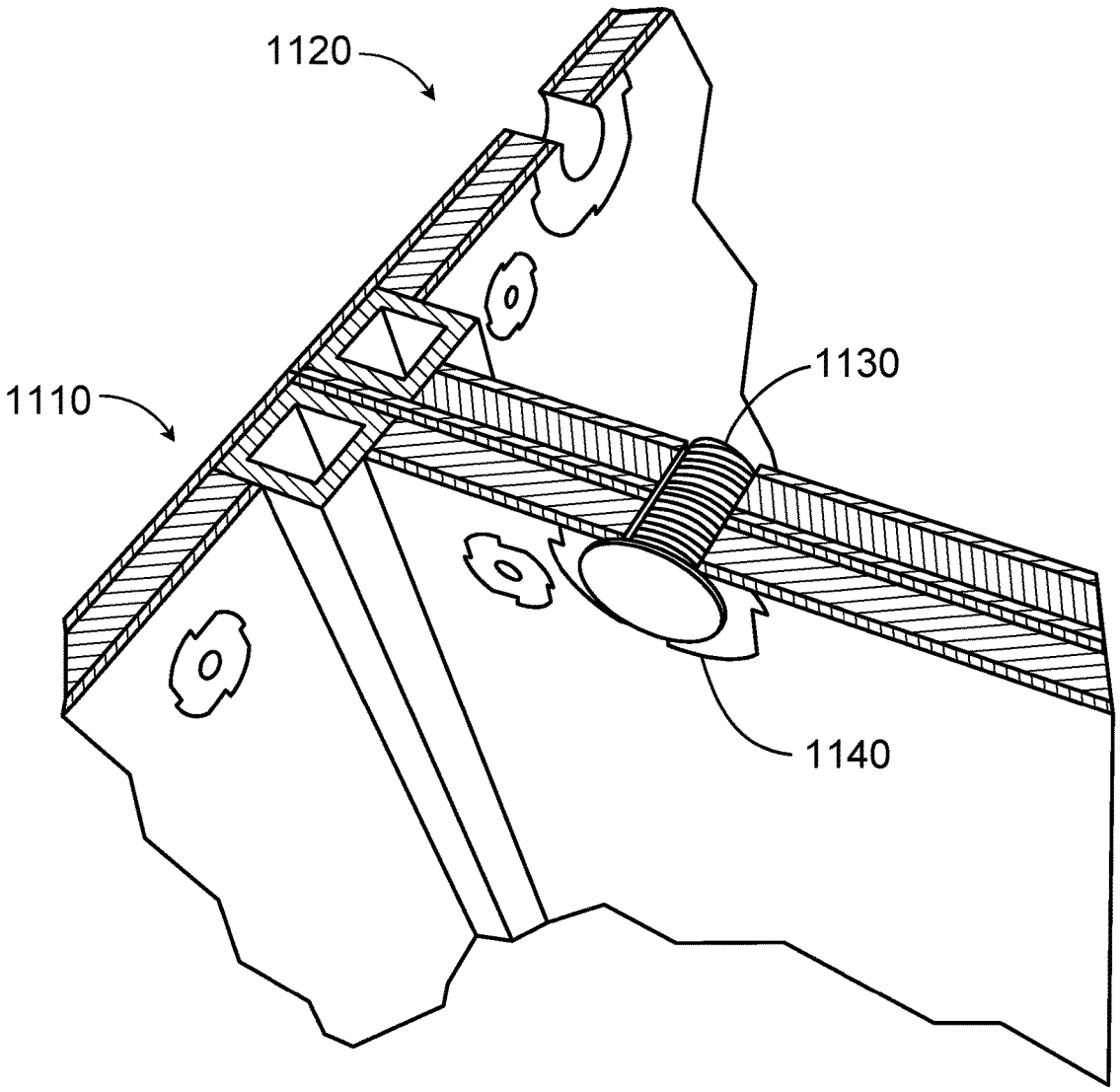
FIG. 11 depicts an exploded view of a method for attaching two prismatic box-like structures horizontally.

Referring to FIG. 11, prismatic box-like structures 1110 and 1120 are mechanically attached horizontally by being fastened together with connector 1130 spanning between two areas 1140 designated for connecting any two horizontally adjoining prismatic box-like structures. The connectors 1130 may be screwed or fastened by robots, so that this process is automated and can be accomplished very quickly.

Figure 12:
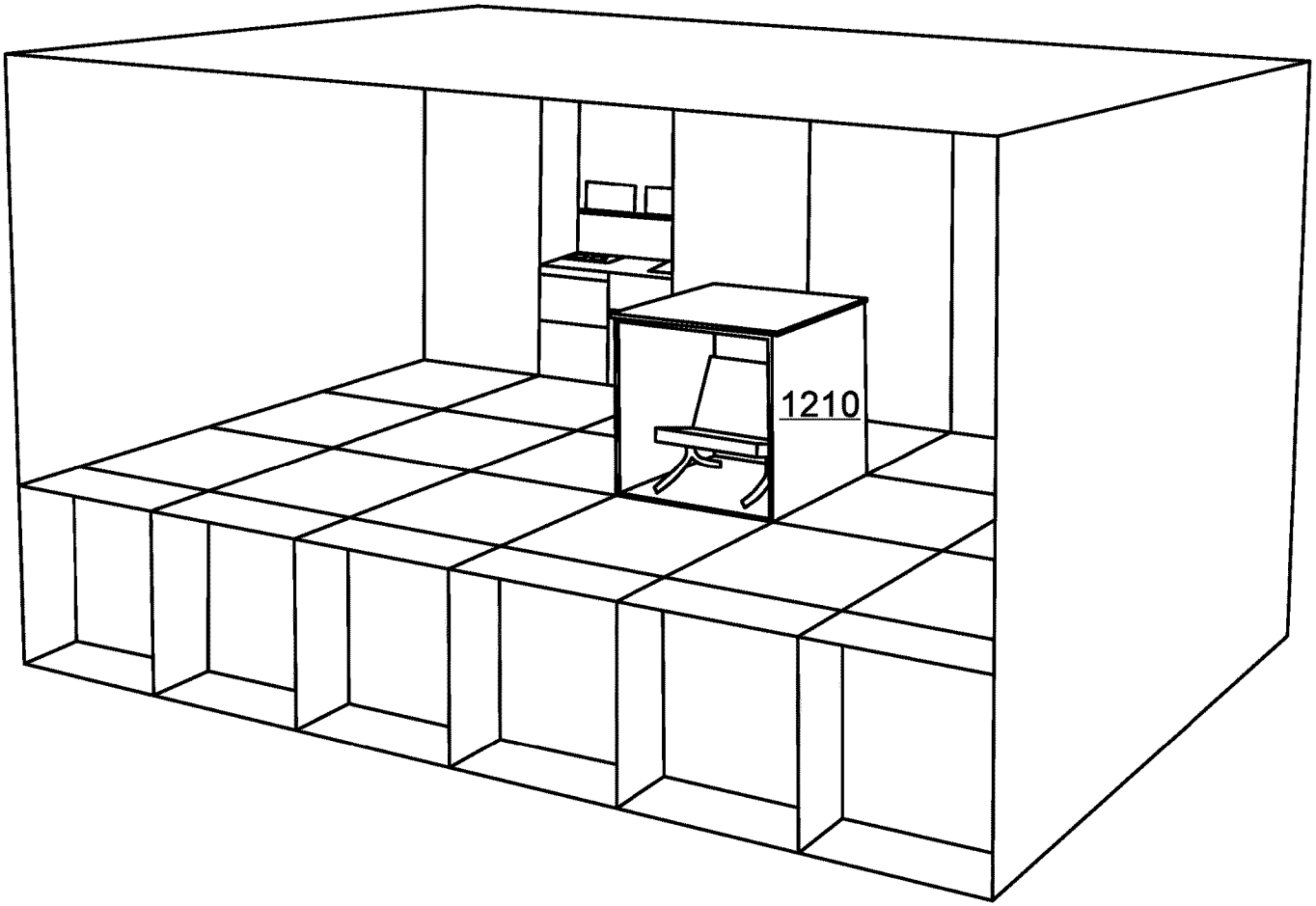
FIG. 12 depicts a perspective view of a finished building built in accordance with the invention and how a space within each prismatic box-like structure can be used for storage.

Referring to FIG. 12, the space within the walls of each prismatic box-like structure 1210 is available for storage. A variety of items may be stored in the prismatic box-like structures, including furniture, appliances, utilities, elevators, carousels, food, clothing, toilets, tubs, showers, beds, movable walls, and so forth.

The invention claimed is:

1. A building infrastructure, comprising:

a plurality of prismatic box structures forming a building;

a first set of the plurality of prismatic box structures forming a frame, the frame comprising exterior walls, a roof and a lowermost floor of the building:

a second set of the plurality of the prismatic box structures being placed side by side and mechanically attached to one another to form an interior of the building, the interior comprising at least one of a floor, a wall and/or a ceiling to form a room;

each of the prismatic box structures comprising an enclosed interior space for storing furniture and appliances therein, the enclosed interior space bounded by a plurality of walls of the respective prismatic box structure;

wherein a first set of walls of the plurality of walls are permanently and rigidly joined to one another and a second set of walls of the plurality of walls being removably joined to the first set of walls, the second set of walls comprising at least one wall;

the second set of walls configured to be removed to allow access to the enclosed interior space.

2. The building infrastructure of claim 1, wherein at least a portion of the plurality of prismatic box structures are placed side by side horizontally and permanently and rigidly mechanically attached to form a length and width of at least one ceiling of the rooms within the building.

3. The building infrastructure of claim 1, wherein at least a portion of the plurality of prismatic box structures are placed side by side horizontally and permanently and rigidly mechanically attached to form a length and width of at least one floor of the rooms within the building.

4. The building infrastructure of claim 1, wherein at least a portion of the plurality of prismatic box structures are placed side by side vertically and permanently and rigidly mechanically attached to each other to form the exterior walls of the frame and the walls of the rooms within the building.

5. The building infrastructure of claim 1, wherein a a volume within the walls of the prismatic box structure measures at least one cubic foot.

6. The building infrastructure of claim 1, wherein a volume within the walls of the prismatic box structures measures about 64 cubic feet (1.81228 cubic meters).

7. The building infrastructure of claim 1, wherein a volume within the walls of the prismatic box structures measures about 224 cubic feet (6.34297 cubic meters).

8. The building infrastructure of claim 1, wherein height, length, and width measurements of the prismatic box structures are about four feet and one and one-half inch (1.295400 meters).

9. The building infrastructure of claim 1, wherein the prismatic box structures measure about four feet and one and one-half inch (1.295400 meters) in width and length and about fourteen feet (4.2672 meters) in height.

10. The building infrastructure of claim 1, wherein the walls of the prismatic box structures comprise oriented strand board (OSB).

11. The building infrastructure of claim 1, wherein the walls of the prismatic box structures comprise an engineered material selected from a group consisting of engineered wood, composite board, particle board, press board, plywood, wood laminates, chip board, gypsum board, cement board, and a combination thereof.

12. The building infrastructure of claim 1, wherein the walls of the prismatic box structures comprise an optically transparent or semi-optically transparent material.

13. The building infrastructure of claim 1, wherein at least one wall of the plurality of walls of the prismatic box structures comprises a translucent material.

14. The building infrastructure of claim 1, wherein the plurality of walls of the prismatic box structures are joined together by means of metal plates and brackets mechanically secured along a perimeter of said plurality of walls.

15. The building infrastructure of claim 14, wherein the metal plates are wrapped around two adjoining wall edges of the plurality of walls and secured by connectors.

16. The building infrastructure of claim 14, wherein the plurality of walls of the prismatic box structures are joined together at top and bottom edges of said plurality of walls with the metal brackets that are secured by connectors.

17. The building infrastructure of claim 1, wherein a mass loaded vinyl (MLV) material is limply attached to at least one side of the plurality of walls of the prismatic box-like box structures.

18. The building infrastructure of claim 17, wherein the MLV material comprises a thickness of about one-thirty-second (0.079375 cm) to about one-fourth inch (0.635 cm).

19. The building infrastructure of claim 1, wherein the plurality of walls of the prismatic box structures are joined in each perpendicular corner by means of square shaped steel bars mechanically attached to said plurality of walls.

20. The building infrastructure of claim 19, wherein the square-shaped steel bars are secured in each perpendicular corner of each prismatic box structure, spanning a length of each corner, by bringing edges of two adjoining walls of the plurality of walls together at approximately a ninety-degree angle, touching two adjacent sides of the square-shaped steel bars, and this configuration secured by wrapping a metal plate around the square-shaped steel bars and edges of the two adjoining walls and secured with connectors.

21. The building infrastructure of claim 19, wherein the square-shaped steel bars in each perpendicular corner comprise two configurations, a first configuration having a protrusion that extends beyond the prismatic box structure in length, and a second configuration having a hollow indentation, these two configurations comprising male and female ends of each square-shaped steel bar for a first purpose of stacking and pinning adjoining vertical said prismatic box structures and for a second purpose of telescoping, so that a top and a bottom wall of the second set of walls of the prismatic box structures can be removed, allowing access to the space within the plurality of walls of the prismatic box structures.

22. The building infrastructure of claim 1, wherein the prismatic box structures are mechanically attached vertically by means of stacking and pinning.

23. The building infrastructure of claim 1, wherein the prismatic box structures are mechanically attached horizontally by being fastened together with a connector spanning between any two horizontally adjoining said prismatic box structures.

24. A building method comprising:

providing a plurality of prismatic box structures forming a building;

a first set of the plurality of prismatic box structures forming a frame, the frame comprising exterior walls, a roof and a lowermost floor of the building;

a second set of the plurality of the prismatic box structures being placed side by side and mechanically attached to one another to form an interior of the building, the interior comprising at least one of a floor, a wall and/or a ceiling to form a room;

each of the prismatic box structures comprising an enclosed interior space for storing furniture and appliances therein, the enclosed interior space bounded by a plurality of walls of the respective prismatic box structure;

wherein a first set of walls of the plurality of walls are permanently and rigidly joined to one another and a second set of walls of the plurality of walls being removably joined to the first set of walls, the second set of walls comprising at least one wall;

the second set of walls configured to be removed to allow access to the enclosed interior space.

* * * * *